US011239550B2

(12) United States Patent
Cooper et al.

(10) Patent No.: US 11,239,550 B2
(45) Date of Patent: Feb. 1, 2022

(54) ELECTRONIC DEVICES HAVING COMPACT ULTRA-WIDEBAND ANTENNAS

(71) Applicant: Apple Inc., Cupertino, CA (US)

(72) Inventors: Aaron J. Cooper, San Jose, CA (US); Amin Tayebi, San Jose, CA (US); Carlo di Nallo, Belmont, CA (US); Ana Papio Toda, San Jose, CA (US)

(73) Assignee: Apple Inc., Cupertino, CA (US)

( * ) Notice: Subject to any disclaimer, the term of this patent is extended or adjusted under 35 U.S.C. 154(b) by 9 days.

(21) Appl. No.: 16/849,776

(22) Filed: Apr. 15, 2020

(65) Prior Publication Data

US 2021/0328334 A1 Oct. 21, 2021

(51) Int. Cl.

| | |
|---|---|
| ***H01Q 1/42*** | (2006.01) |
| ***H01Q 1/24*** | (2006.01) |
| ***H01Q 3/44*** | (2006.01) |
| ***H01Q 1/52*** | (2006.01) |

(52) U.S. Cl.

CPC ..... *H01Q 1/422* (2013.01); *H01Q 1/243* (2013.01); *H01Q 1/526* (2013.01); *H01Q 3/446* (2013.01)

(58) Field of Classification Search

CPC ..... H01G 1/422; H01G 1/243; H01G 1/526; H01G 3/446

See application file for complete search history.

(56) References Cited

U.S. PATENT DOCUMENTS

| | | | | |
|---|---|---|---|---|
| 10,135,139 | B2 | 11/2018 | Contreras et al. | |
| 10,574,294 | B2 | 2/2020 | Barzegar et al. | |
| 2010/0283701 | A1* | 11/2010 | Cheng | H01Q 9/285 343/793 |
| 2018/0115060 | A1 | 4/2018 | Bennett et al. | |
| 2018/0159238 | A1 | 6/2018 | Wolniansky | |

OTHER PUBLICATIONS

U.S. Appl. No. 16/277,808, filed Feb. 15, 2019.
U.S. Appl. No. 16/456,856, filed Jun. 28, 2019.

* cited by examiner

*Primary Examiner* — Graham P Smith
(74) *Attorney, Agent, or Firm* — Treyz Law Group, P.C.; Michael H. Lyons

(57) ABSTRACT

An electronic device may be provided with an antenna for receiving signals in first and second ultra-wideband communications bands. The antenna may include a shielding ring that runs around first and second arms. The first arm may radiate in the first band and the second arm may radiate in the second band. The first arm may have an end formed from a first segment of the ring and a radiating edge facing the second arm. The second arm may have an end formed from a second segment of the ring and a radiating edge facing the first arm. First and second sets of conductive vias may couple the ring to ground. The first set may form a return path for the first arm. The second set may form a return path for the second arm.

20 Claims, 13 Drawing Sheets

ELECTRONIC DEVICES HAVING COMPACT ULTRA-WIDEBAND ANTENNAS

BACKGROUND

This relates to electronic devices and, more particularly, to electronic devices with wireless communications circuitry.

Electronic devices often include wireless communications circuitry. For example, cellular telephones, computers, and other devices often contain antennas and wireless transceivers for supporting wireless communications. Some electronic devices perform location detection operations to detect the location of an external device based on an angle of arrival of signals received from the external device (using multiple antennas).

To satisfy consumer demand for small form factor wireless devices, manufacturers are continually striving to implement wireless communications circuitry such as antenna components for performing location detection operations using compact structures. At the same time, there is a desire for wireless devices to cover a growing number of frequency bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies.

It would therefore be desirable to be able to provide improved wireless communications circuitry for wireless electronic devices.

SUMMARY

An electronic device may be provided with wireless circuitry and control circuitry. The wireless circuitry may include antennas that are used to determine the position and orientation of the electronic device relative to external wireless equipment. The control circuitry may determine the position and orientation of the electronic device relative to the external wireless equipment at least in part by measuring the angle of arrival of radio-frequency signals from the external wireless equipment. The radio-frequency signals may be received in at least first and second ultra-wideband communications bands.

The antennas may be formed on a flexible printed circuit structure. Each antenna may include a dielectric substrate on the flexible printed circuit structure. Ground traces may be patterned on a first surface of the dielectric substrate. Conductive traces may be patterned on a second surface of the dielectric substrate. The conductive traces may include a grounded shielding ring having opposing first and second sides and may include first and second antenna arms. The first arm may extend from the first side of the grounded shielding ring to a first radiating edge. The second arm may extend from the second side of the grounded shielding to a second radiating edge. The second radiating edge may face the first radiating edge and may be separated from the first radiating edge by a gap. The first arm may radiate in a first ultra-wideband communications band. The second arm may radiate in a second ultra-wideband communications band.

A first set of conductive vias may couple the first side of the grounded shielding ring to the ground traces. A second set of conductive vias may couple the second side of the grounded shielding ring to the ground traces. Additional conductive vias may couple other portions of the grounded shielding ring to the ground traces. The first set of conductive vias may short the first antenna arm to the ground traces and may thereby form a return path for the first antenna arm. The second set of conductive vias may short the second antenna arm to the ground traces and may thereby form a return path for the second antenna arm (e.g., the antenna may be a dual-band planar inverted-F antenna having antenna arms extending from opposing sides of the grounded shielding ring). At the same time, the first and second sets of conductive vias and the grounded shielding ring may help to isolate the antenna from electromagnetic interference.

The electronic device may have a dielectric cover layer and a conductive support plate on the dielectric cover layer. An opening may be formed in the conductive support plate. The dielectric substrate may be mounted within the opening. The first and second arms and the grounded shielding ring may be pressed against the dielectric cover layer. A flexible printed circuit tail may extend from the dielectric substrate. The flexible printed circuit tail may include one or more bends. When configured in this way, the antenna may be relatively immune to impedance discontinuities at the dielectric cover layer and may exhibit a relatively compact lateral footprint, thereby minimizing space consumption within the electronic device without sacrificing radio-frequency performance.

DETAILED DESCRIPTION

Figure 1:
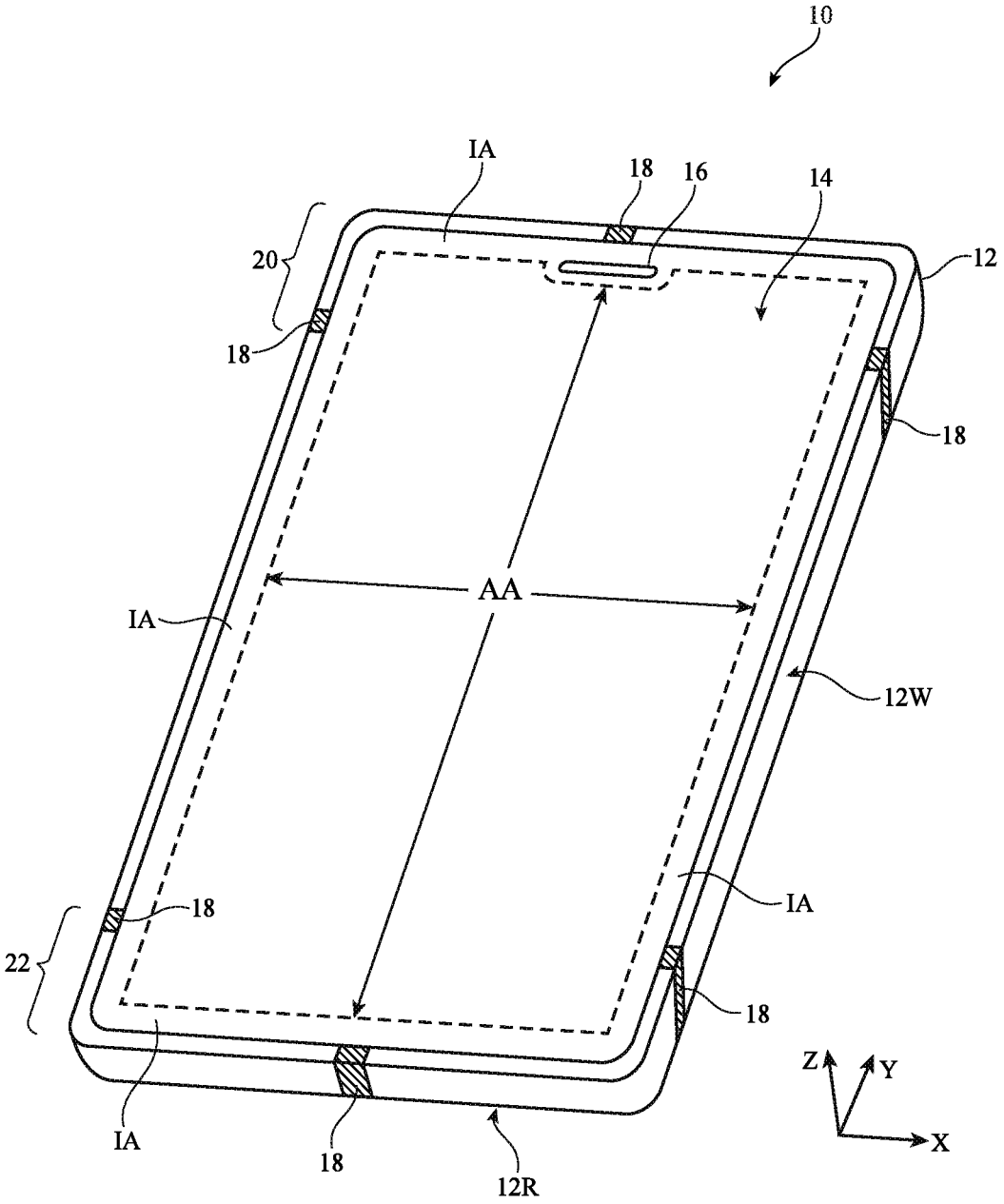
FIG. 1 is a perspective view of an illustrative electronic device in accordance with some embodiments.

Electronic devices such as electronic device 10 of FIG. 1 may be provided with wireless circuitry (sometimes referred to herein as wireless communications circuitry). The wireless circuitry may be used to support wireless communications in multiple wireless communications bands. Communications bands (sometimes referred to herein as frequency bands) handled by the wireless circuitry can include satellite navigation system communications bands, cellular telephone communications bands, wireless local area network communications bands, near-field communications bands, ultra-wideband communications bands, or other wireless communications bands.

The wireless circuitry may include one or more antennas. The antennas of the wireless circuitry can include loop antennas, inverted-F antennas, strip antennas, planar inverted-F antennas, patch antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two gaps 18), three peripheral conductive segments (e.g., in an arrangement with three gaps 18), four peripheral conductive segments (e.g., in an arrangement with four gaps 18), six peripheral conductive segments (e.g., in an arrangement with six gaps 18), etc. The segments of peripheral conductive housing structures 12W that are formed in this way may form parts of antennas in device 10 if desired.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, ultra-wideband communications, etc.

Figure 2:
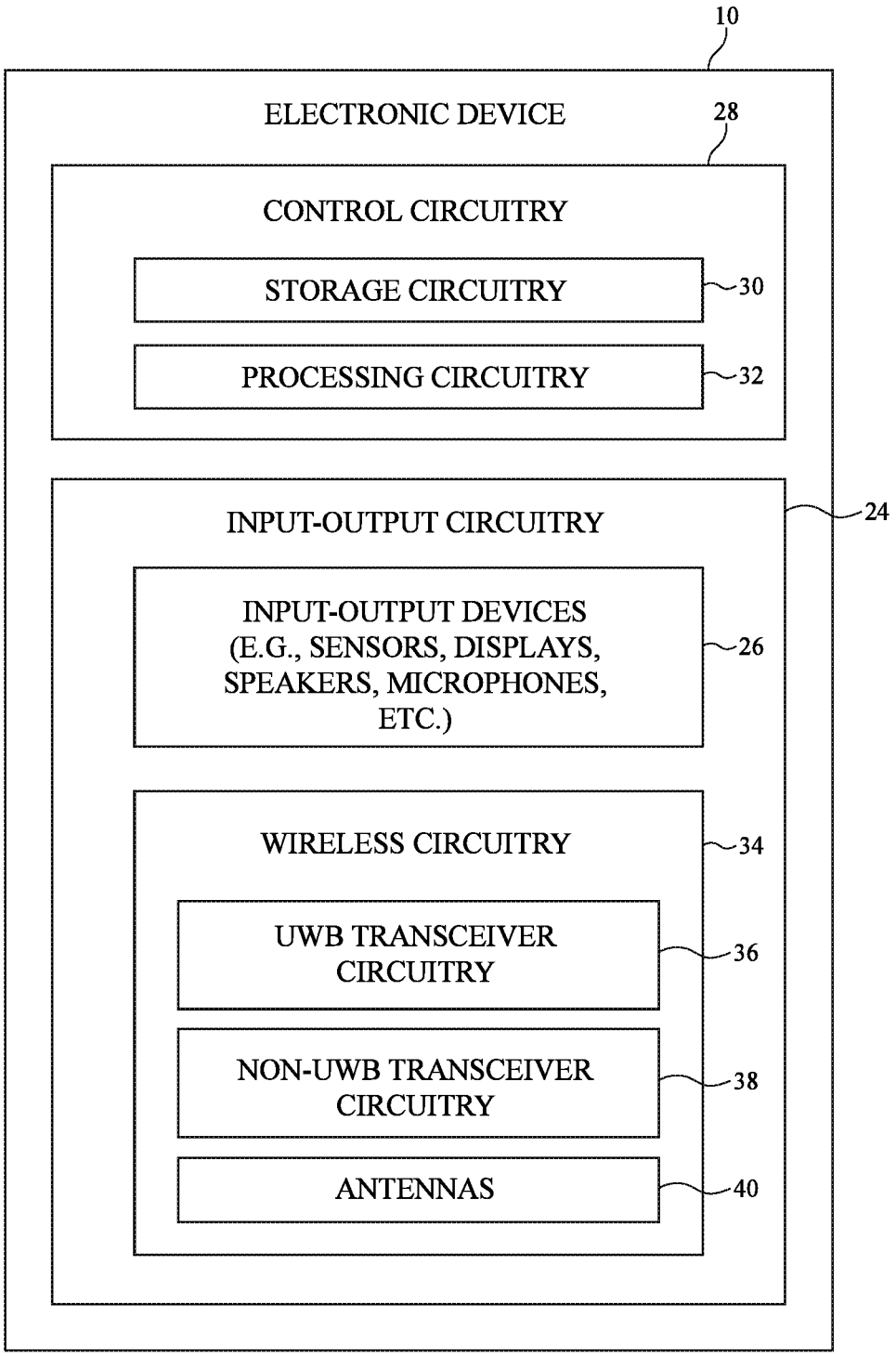
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 (sometimes referred to herein as wireless communications circuitry 34) for wirelessly conveying radio-frequency signals. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 (e.g., processing circuitry 32) may include baseband processor circuitry or other control components that form a part of wireless circuitry 34.

Wireless circuitry 34 may include radio-frequency transceiver circuitry for handling various radio-frequency communications bands. For example, wireless circuitry 34 may include ultra-wideband (UWB) transceiver circuitry 36 that supports communications using the IEEE 802.15.4 protocol and/or other ultra-wideband communications protocols. Ultra-wideband radio-frequency signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Ultra-wideband transceiver circuitry 36 may operate (i.e., convey radio-frequency signals) in frequency bands such as an ultra-wideband communications band between about 5 GHz and about 8.5 GHz (e.g., a 6.5 GHz UWB communications band, an 8 GHz UWB communications band, and/or at other suitable frequencies).

As shown in FIG. 2, wireless circuitry 34 may also include non-UWB transceiver circuitry 38. Non-UWB transceiver circuitry 38 may handle communications bands other than UWB communications bands such as 2.4 GHz and 5 GHz bands for Wi-Fi® (IEEE 802.11) communications or communications in other wireless local area network (WLAN) bands, the 2.4 GHz Bluetooth® communications band or other wireless personal area network (WPAN) bands, and/or cellular telephone frequency bands such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples).

Non-UWB transceiver circuitry 38 may handle voice data and non-voice data. Wireless circuitry 34 may include circuitry for other short-range and long-range wireless links if desired. For example, wireless circuitry 34 may include 60 GHz transceiver circuitry (e.g., millimeter wave transceiver circuitry), circuitry for receiving television and radio signals, paging system transceivers, near field communications (NFC) circuitry, etc.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band or, if desired, antennas 40 can be configured to convey both radio-frequency signals in a UWB communications band and radio-frequency signals in a non-UWB communications band (e.g., wireless local area network signals and/or cellular telephone signals). Antennas 40 can include two or more antennas for handling ultra-wideband wireless communication. In one suitable arrangement that is described herein as an example, antennas 40 include one or more groups of three antennas (sometimes referred to herein as triplets of antennas) for handling ultra-wideband wireless communication. Antennas 40 may include one or more doublets (pairs) of antennas for handling ultra-wideband wireless communication if desired.

Space is often at a premium in electronic devices such as device 10. In order to minimize space consumption within device 10, the same antenna 40 may be used to cover multiple frequency bands. In one suitable arrangement that is described herein as an example, each antenna 40 that is used to perform ultra-wideband wireless communication may be a multi-band antenna that conveys (e.g., transmits and/or receives) radio-frequency signals in at least two ultra-wideband communications bands (e.g., the 6.5 GHz UWB communications band and the 8.0 GHz UWB communications band). In another suitable arrangement that is described herein as an example, each antenna 40 may convey radio-frequency signals in a single ultra-wideband communications band but antennas 40 may include different antennas that cover different ultra-wideband frequencies. Radio-frequency signals that are conveyed in UWB communications bands (e.g., using a UWB protocol) may sometimes be referred to herein as UWB signals or UWB radio-frequency signals. Radio-frequency signals in frequency bands other than the UWB communications bands (e.g., radio-frequency signals in cellular telephone frequency bands, WPAN frequency bands, WLAN frequency bands, etc.) may sometimes be referred to herein as non-UWB signals or non-UWB radio-frequency signals.

Figure 3:
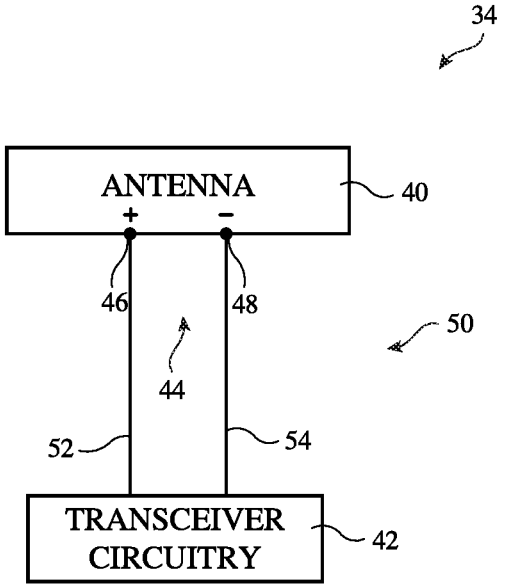
FIG. 3 is a schematic diagram of illustrative wireless circuitry in accordance with some embodiments.

A schematic diagram of wireless circuitry 34 is shown in FIG. 3. As shown in FIG. 3, wireless circuitry 34 may include transceiver circuitry 42 (e.g., UWB transceiver circuitry 36 or non-UWB transceiver circuitry 38 of FIG. 2) that is coupled to a given antenna 40 using a radio-frequency transmission line path such as radio-frequency transmission line path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Radio-frequency transmission line path 50 may include one or more radio-frequency transmission lines (sometimes referred to herein simply as transmission lines). Radio-frequency transmission line path 50 (e.g., the transmission lines in radio-frequency transmission line path 50) may include a positive signal conductor such as positive signal conductor 52 and a ground signal conductor such as ground conductor 54.

The transmission lines in radio-frequency transmission line path 50 may, for example, include coaxial cable transmission lines (e.g., ground conductor 54 may be implemented as a grounded conductive braid surrounding signal conductor 52 along its length), stripline transmission lines (e.g., where ground conductor 54 extends along two sides of signal conductor 52), a microstrip transmission line (e.g., where ground conductor 54 extends along one side of signal conductor 52), coaxial probes realized by a metalized via, edge-coupled microstrip transmission lines, edge-coupled stripline transmission lines, waveguide structures (e.g., coplanar waveguides or grounded coplanar waveguides), combinations of these types of transmission lines and/or other transmission line structures, etc. In one suitable arrangement that is sometimes described herein as an example, radio-frequency transmission line path 50 may include a stripline transmission line coupled to transceiver circuitry 42 and a microstrip transmission line coupled between the stripline transmission line and antenna 40.

Transmission lines in radio-frequency transmission line path 50 may be integrated into rigid and/or flexible printed circuit boards. In one suitable arrangement, radio-frequency transmission line path 50 may include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of radio-frequency transmission line path 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Radio-frequency transmission line path 50 may be coupled to antenna feed structures associated with antenna 40. As an example, antenna 40 may form an inverted-F antenna, a planar inverted-F antenna, a patch antenna, or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of transceiver circuitry 42 over a corresponding transmission line. If desired, signal conductor 52 may be coupled to multiple locations on antenna 40 (e.g., antenna 40 may include multiple positive antenna feed terminals coupled to signal conductor 52 of the same radio-frequency transmission line path 50). Switches may be interposed on the signal conductor between transceiver circuitry 42 and the positive antenna feed terminals if desired (e.g., to selectively activate one or more positive antenna feed terminals at any given time). The illustrative feeding configuration of FIG. 3 is merely illustrative.

During operation, device 10 may communicate with external wireless equipment. If desired, device 10 may use radio-frequency signals conveyed between device 10 and the external wireless equipment to identify a location of the external wireless equipment relative to device 10. Device 10 may identify the relative location of the external wireless equipment by identifying a range to the external wireless equipment (e.g., the distance between the external wireless equipment and device 10) and the angle of arrival (AoA) of radio-frequency signals from the external wireless equipment (e.g., the angle at which radio-frequency signals are received by device 10 from the external wireless equipment).

Figure 4:
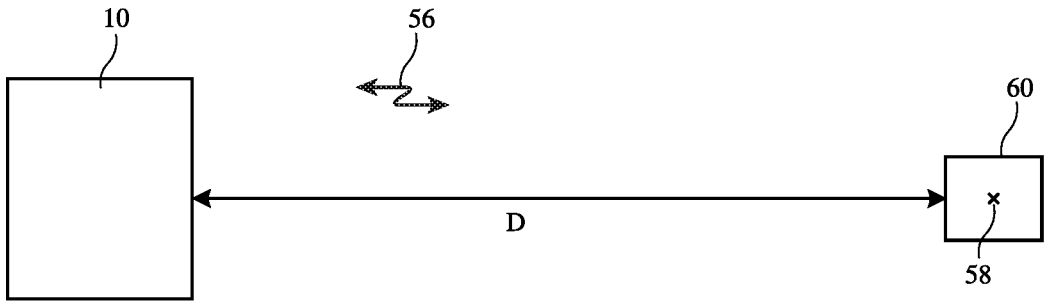
FIG. 4 is a diagram of an illustrative electronic device in wireless communication with an external node in a network in accordance with some embodiments.

FIG. 4 is a diagram showing how device 10 may determine a distance D between device 10 and external wireless equipment such as wireless network node 60 (sometimes referred to herein as wireless equipment 60, wireless device 60, external device 60, or external equipment 60). Node 60 may include devices that are capable of receiving and/or transmitting radio-frequency signals such as radio-frequency signals 56. Node 60 may include tagged devices (e.g., any suitable object that has been provided with a wireless receiver and/or a wireless transmitter), electronic equipment (e.g., an infrastructure-related device), and/or other electronic devices (e.g., devices of the type described in connection with FIG. 1, including some or all of the same wireless communications capabilities as device 10).

For example, node 60 may be a laptop computer, a tablet computer, a somewhat smaller device such as a wrist-watch device, pendant device, headphone device, earpiece device, headset device (e.g., virtual or augmented reality headset devices), or other wearable or miniature device, a handheld device such as a cellular telephone, a media player, or other small portable device. Node 60 may also be a set-top box, a camera device with wireless communications capabilities, a desktop computer, a display into which a computer or other processing circuitry has been integrated, a display without an integrated computer, or other suitable electronic equipment. Node 60 may also be a key fob, a wallet, a book, a pen, or other object that has been provided with a low-power transmitter (e.g., an RFID transmitter or other transmitter). Node 60 may be electronic equipment such as a thermostat, a smoke detector, a Bluetooth® Low Energy (Bluetooth LE) beacon, a Wi-Fi® wireless access point, a wireless base station, a server, a heating, ventilation, and air conditioning (HVAC) system (sometimes referred to as a temperature-control system), a light source such as a light-emitting diode (LED) bulb, a light switch, a power outlet, an occupancy detector (e.g., an active or passive infrared light detector, a microwave detector, etc.), a door sensor, a moisture sensor, an electronic door lock, a security camera, or other device. Device 10 may also be one of these types of devices if desired.

As shown in FIG. 4, device 10 may communicate with node 60 using wireless radio-frequency signals 56. Radio-frequency signals 56 may include Bluetooth® signals, near-field communications signals, wireless local area network signals such as IEEE 802.11 signals, millimeter wave communication signals such as signals at 60 GHz, UWB signals, other radio-frequency wireless signals, infrared signals, etc. In one suitable arrangement that is described herein by example, radio-frequency signals 56 are UWB signals conveyed in multiple UWB communications bands such as the 6.5 GHz and 8 GHz UWB communications bands. Radio-frequency signals 56 may be used to determine and/or convey information such as location and orientation information. For example, control circuitry 28 in device 10 (FIG. 2) may determine the location 58 of node 60 relative to device 10 using radio-frequency signals 56.

In arrangements where node 60 is capable of sending or receiving communications signals, control circuitry 28 (FIG. 2) on device 10 may determine distance D using radio-frequency signals 56 of FIG. 4. The control circuitry may determine distance D using signal strength measurement schemes (e.g., measuring the signal strength of radio-frequency signals 56 from node 60) or using time-based measurement schemes such as time of flight measurement techniques, time difference of arrival measurement techniques, angle of arrival measurement techniques, triangulation methods, time-of-flight methods, using a crowdsourced location database, and other suitable measurement techniques. This is merely illustrative, however. If desired, the control circuitry may use information from Global Positioning System receiver circuitry, proximity sensors (e.g., infrared proximity sensors or other proximity sensors), image data from a camera, motion sensor data from motion sensors, and/or using other circuitry on device 10 to help determine distance D. In addition to determining the distance D between device 10 and node 60, the control circuitry may determine the orientation of device 10 relative to node 60.

Figure 5:
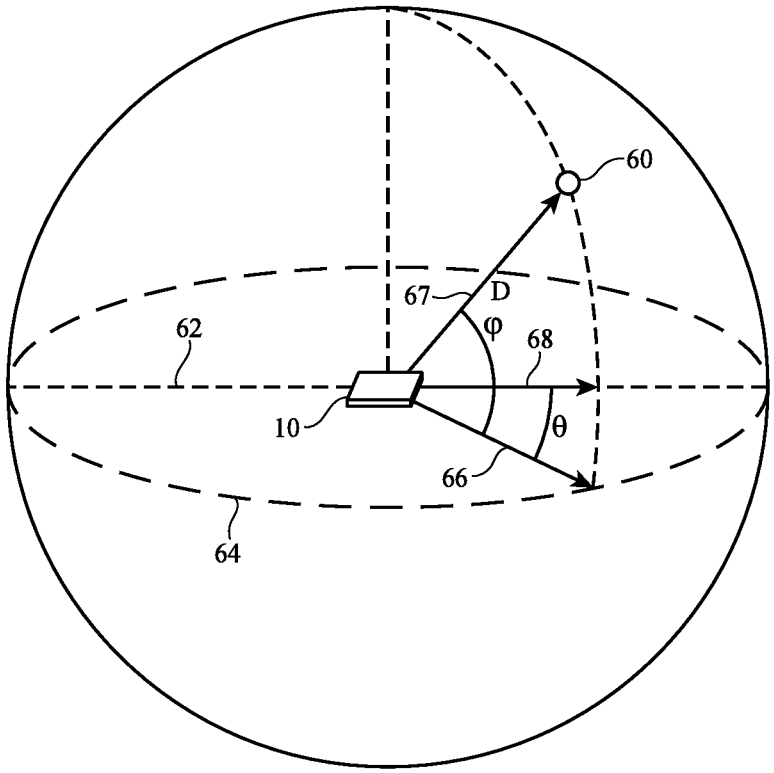
FIG. 5 is a diagram showing how the location (e.g., range and angle of arrival) of an external node in a network may be determined relative to an electronic device in accordance with some embodiments.

FIG. 5 illustrates how the position and orientation of device 10 relative to nearby nodes such as node 60 may be determined. In the example of FIG. 5, the control circuitry on device 10 (e.g., control circuitry 28 of FIG. 2) uses a horizontal polar coordinate system to determine the location and orientation of device 10 relative to node 60. In this type of coordinate system, the control circuitry may determine an azimuth angle θ and/or an elevation angle φ to describe the position of nearby nodes 60 relative to device 10. The control circuitry may define a reference plane such as local horizon 64 and a reference vector such as reference vector 68. Local horizon 64 may be a plane that intersects device 10 and that is defined relative to a surface of device 10 (e.g., the front or rear face of device 10). For example, local horizon 64 may be a plane that is parallel to or coplanar with display 14 of device 10 (FIG. 1). Reference vector 68 (sometimes referred to as the "north" direction) may be a vector in local horizon 64. If desired, reference vector 68 may be aligned with longitudinal axis 62 of device 10 (e.g., an axis running lengthwise down the center of device 10 and parallel to the longest rectangular dimension of device 10, parallel to the Y-axis of FIG. 1). When reference vector 68 is aligned with longitudinal axis 62 of device 10, reference vector 68 may correspond to the direction in which device 10 is being pointed.

Azimuth angle θ and elevation angle φ may be measured relative to local horizon 64 and reference vector 68. As shown in FIG. 5, the elevation angle φ (sometimes referred to as altitude) of node 60 is the angle between node 60 and local horizon 64 of device 10 (e.g., the angle between vector 67 extending between device 10 and node 60 and a coplanar vector 66 extending between device 10 and local horizon 64). The azimuth angle θ of node 60 is the angle of node 60 around local horizon 64 (e.g., the angle between reference vector 68 and vector 66). In the example of FIG. 5, the azimuth angle θ and elevation angle φ of node 60 are greater than 0°.

If desired, other axes besides longitudinal axis 62 may be used to define reference vector 68. For example, the control circuitry may use a horizontal axis that is perpendicular to longitudinal axis 62 as reference vector 68. This may be useful in determining when nodes 60 are located next to a side portion of device 10 (e.g., when device 10 is oriented side-to-side with one of nodes 60).

After determining the orientation of device 10 relative to node 60, the control circuitry on device 10 may take suitable action. For example, the control circuitry may send information to node 60, may request and/or receive information from 60, may use display 14 (FIG. 1) to display a visual indication of wireless pairing with node 60, may use speakers to generate an audio indication of wireless pairing with node 60, may use a vibrator, a haptic actuator, or other mechanical element to generate haptic output indicating wireless pairing with node 60, may use display 14 to display a visual indication of the location of node 60 relative to device 10, may use speakers to generate an audio indication of the location of node 60, may use a vibrator, a haptic actuator, or other mechanical element to generate haptic output indicating the location of node 60, and/or may take other suitable action.

In one suitable arrangement, device 10 may determine the distance between the device 10 and node 60 and the orientation of device 10 relative to node 60 using two or more ultra-wideband antennas. The ultra-wide band antennas may receive radio-frequency signals from node 60 (e.g., radio-frequency signals 56 of FIG. 4). Time stamps in the wireless communication signals may be analyzed to determine the time of flight of the wireless communication signals and thereby determine the distance (range) between device 10 and node 60. Additionally, angle of arrival (AoA) measurement techniques may be used to determine the orientation of electronic device 10 relative to node 60 (e.g., azimuth angle θ and elevation angle φ).

In angle of arrival measurement, node 60 transmits a radio-frequency signal to device 10 (e.g., radio-frequency signals 56 of FIG. 4). Device 10 may measure a delay in arrival time of the radio-frequency signals between the two or more ultra-wideband antennas. The delay in arrival time (e.g., the difference in received phase at each ultra-wideband antenna) can be used to determine the angle of arrival of the radio-frequency signal (and therefore the angle of node 60 relative to device 10). Once distance D and the angle of arrival have been determined, device 10 may have knowledge of the precise location of node 60 relative to device 10.

Figure 6:
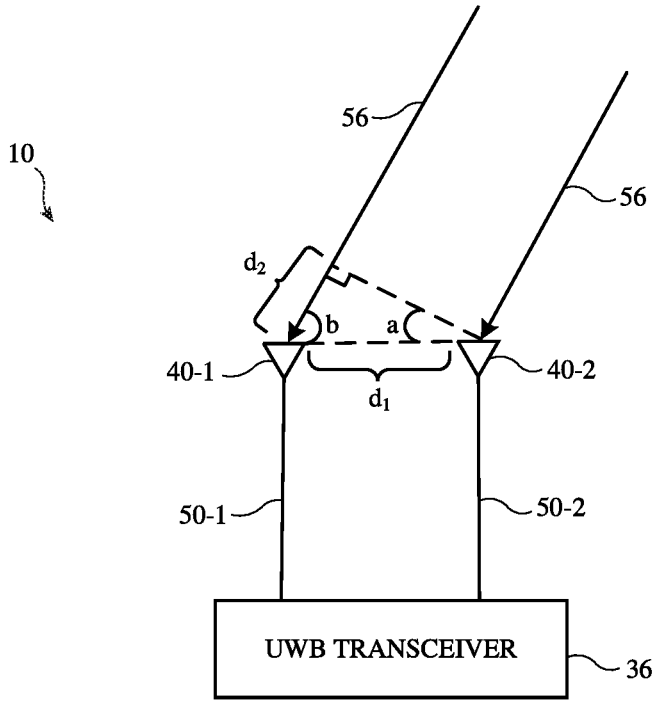
FIG. 6 is a diagram showing how illustrative antennas in an electronic device may be used for detecting angle of arrival in accordance with some embodiments.

FIG. 6 is a schematic diagram showing how angle of arrival measurement techniques may be used to determine the orientation of device 10 relative to node 60. As shown in FIG. 6, device 10 may include multiple antennas (e.g., a first antenna 40-1 and a second antenna 40-2) coupled to UWB transceiver circuitry 36 over respective radio-frequency transmission line paths (e.g., a first radio-frequency transmission line path 50-1 and a second radio-frequency transmission line path 50-2). UWB transceiver circuitry 36 and antennas 40-1 and 40-2 may operate at UWB frequencies (e.g., UWB transceiver circuitry 36 may convey (transmit and/or receive) UWB signals using antennas 40-1 and 40-2).

Antennas 40-1 and 40-2 may each receive radio-frequency signals 56 from node 60 (FIG. 5). Antennas 40-1 and 40-2 may be laterally separated by a distance $d_1$, where antenna 40-1 is farther away from node 60 than antenna 40-2 (in the example of FIG. 6). Therefore, radio-frequency signals 56 travel a greater distance to reach antenna 40-1 than antenna 40-2. The additional distance between node 60 and antenna 40-1 is shown in FIG. 6 as distance $d_2$. FIG. 6 also shows angles a and b (where a+b=90°).

Distance $d_2$ may be determined as a function of angle a or angle b (e.g., $d_2=d_1*\sin(a)$ or $d_2=d_1*\cos(b)$). Distance $d_2$ may also be determined as a function of the phase difference between the signal received by antenna 40-1 and the signal received by antenna 40-2 (e.g., $d_2=(PD)*\lambda/(2*\pi)$), where PD is the phase difference (sometimes written "$\Delta\phi$") between the signal received by antenna 40-1 and the signal received by antenna 40-2, and $\lambda$ is the wavelength of radio-frequency signals 56. Device 10 may include phase measurement circuitry coupled to each antenna to measure the phase of the received signals and to identify phase difference PD (e.g., by subtracting the phase measured for one antenna from the phase measured for the other antenna). The two equations for $d_2$ may be set equal to each other (e.g., $d_1*\sin(a)=(PD)*\lambda/(2*\pi)$) and rearranged to solve for the angle a (e.g., $a=\sin^{-1}((PD)*\lambda/(2*\pi*d_1))$ or the angle b. Therefore, the angle of arrival may be determined (e.g., by control circuitry 28 of FIG. 2) based on the known (predetermined) distance $d_1$ between antennas 40-1 and 40-2, the detected (measured) phase difference PD between the signal received by antenna 40-1 and the signal received by antenna 40-2, and the known wavelength (frequency) of the received radio-frequency signals 56. Angles a and/or b of FIG. 6 may be converted to spherical coordinates to obtain azimuth angle $\theta$ and elevation angle $\varphi$ of FIG. 5, for example. Control circuitry 28 (FIG. 2) may determine the angle of arrival of radio-frequency signals 56 by calculating one or both of azimuth angle $\theta$ and elevation angle $\varphi$.

Distance $d_1$ may be selected to ease the calculation for phase difference PD between the signal received by antenna 40-1 and the signal received by antenna 40-2. For example, $d_1$ may be less than or equal to one half of the wavelength (e.g., effective wavelength) of the received radio-frequency signals 56 (e.g., to avoid multiple phase difference solutions).

With two antennas for determining angle of arrival (as in FIG. 6), the angle of arrival within a single plane may be determined. For example, antennas 40-1 and 40-2 in FIG. 6 may be used to determine azimuth angle $\theta$ of FIG. 5. A third antenna may be included to enable angle of arrival determination in multiple planes (e.g., azimuth angle $\theta$ and elevation angle $\varphi$ of FIG. 5 may both be determined). The three antennas in this scenario may form a so-called triplet of antennas, where each antenna in the triplet is arranged to lie on a respective corner of a right triangle (e.g., the triplet may include antennas 40-1 and 40-2 of FIG. 6 and a third antenna located at distance $d_1$ from antenna 40-1 in a direction perpendicular to the vector between antennas 40-1 and 40-2). Triplets of antennas 40 may be used to determine angle of arrival in two planes (e.g., to determine both azimuth angle $\theta$ and elevation angle $\varphi$ of FIG. 5). Triplets of antennas 40 and/or doublets of antennas (e.g., a pair of antennas such as antennas 40-1 and 40-2 of FIG. 6) may be used in device 10 to determine angle of arrival. If desired, different doublets of antennas may be oriented orthogonally with respect to each other in device 10 to recover angle of arrival in two dimensions (e.g., using two or more orthogonal doublets of antennas 40 that each measure angle of arrival in a single respective plane).

Figure 7:
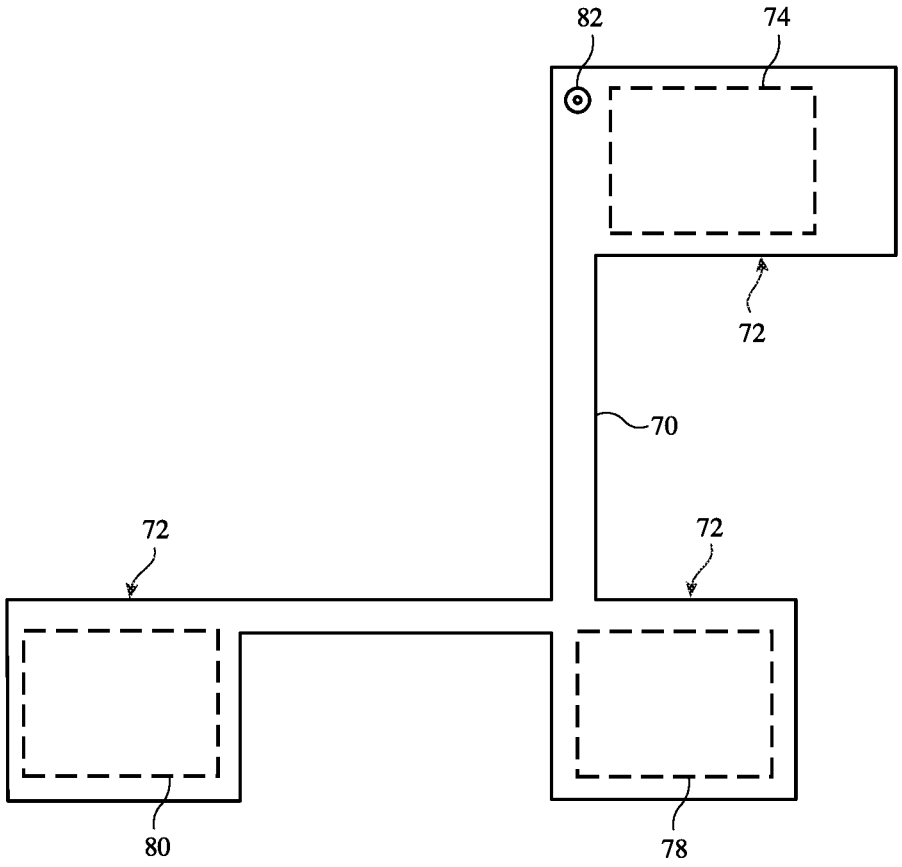
FIG. 7 is a schematic diagram of an illustrative flexible printed circuit structure having antennas for detecting range and angle of arrival in accordance with some embodiments.

If desired, each antenna in a triplet or doublet of antennas used by device 10 for performing ultra-wideband communications may be mounted to a common (shared) substrate such as a common flexible printed circuit structure. FIG. 7 is a top-down view showing how antennas 40 may be mounted to a common flexible printed circuit structure. As shown in FIG. 7, two or more antennas for performing ultra-wideband communications (e.g., a triplet of antennas) may be mounted to flexible printed circuit structure 70. Flexible printed circuit structure 70 may be bent or folded along one or more axes if desired (e.g., to accommodate the presence of other electronic device components in the vicinity of flexible printed circuit structure 70).

Flexible printed circuit structure 70 may include portions 72 (sometimes referred to herein as stub portions 72 or stubs 72). Antennas 40 for performing ultra-wideband communications may be formed within regions 80, 78, and 74 on stubs 72 of flexible printed circuit structure 70. For example, a triplet of antennas 40 for performing ultra-wideband communications may include a first antenna in region 74, a second antenna in region 78, and a third antenna in region 80.

Radio-frequency transmission line paths (e.g., radio-frequency transmission line path 50 of FIG. 3) may be formed on flexible printed circuit structure 70 and may be coupled to the antennas in regions 80, 78, and 74. Flexible printed circuit structure 70 may include one or more radio-frequency connectors 82 (e.g., at one or more of stubs 72 or elsewhere in flexible printed circuit structure 70). Radio-frequency connector 82 may couple the radio-frequency transmission line paths on flexible printed circuit structure 70 to transceiver circuitry in device 10 (e.g., transceiver circuitry 42 of FIG. 3). The transceiver circuitry may, for example, be mounted to a different substrate such as a main logic board for device 10.

Flexible printed circuit structure 70 may include, one, two, three, or more than three flexible printed circuits. Each flexible printed circuit may be mounted (e.g., soldered, surface mounted, adhered, etc.) to at least one other flexible printed circuit in flexible printed circuit structure 70 if desired. In one suitable arrangement, regions 80 and 78 are located on a first flexible printed circuit whereas region 74 is located on a second flexible printed circuit that is surface mounted to the first flexible printed circuit. In another suitable arrangement, each of regions 80, 78, and 74 are located on respective flexible printed circuits that are surface mounted together. Radio-frequency connector 82 may be mounted to any desired location on flexible printed circuit structure 70.

The example of FIG. 7 is merely illustrative. In general, flexible printed circuit structure 70 may have any desired shape. Flexible printed circuit structure 70 need not include stubs 72 (e.g., flexible printed circuit structure 70 may have a rectangular shape or other shapes). One of regions 80, 78, and 74 may be omitted in scenarios where only a doublet of antennas is formed on flexible printed circuit structure 70 for performing ultra-wideband communications. In another suitable arrangement, flexible printed circuit structure 70 of FIG. 7 may be replaced with a rigid printed circuit board or other substrates for antennas 40. If desired, other components may be mounted to flexible printed circuit structure 70 (e.g., input-output devices 26 or portions of control circuitry 28 of FIG. 2, additional antennas, etc.).

Figure 8:
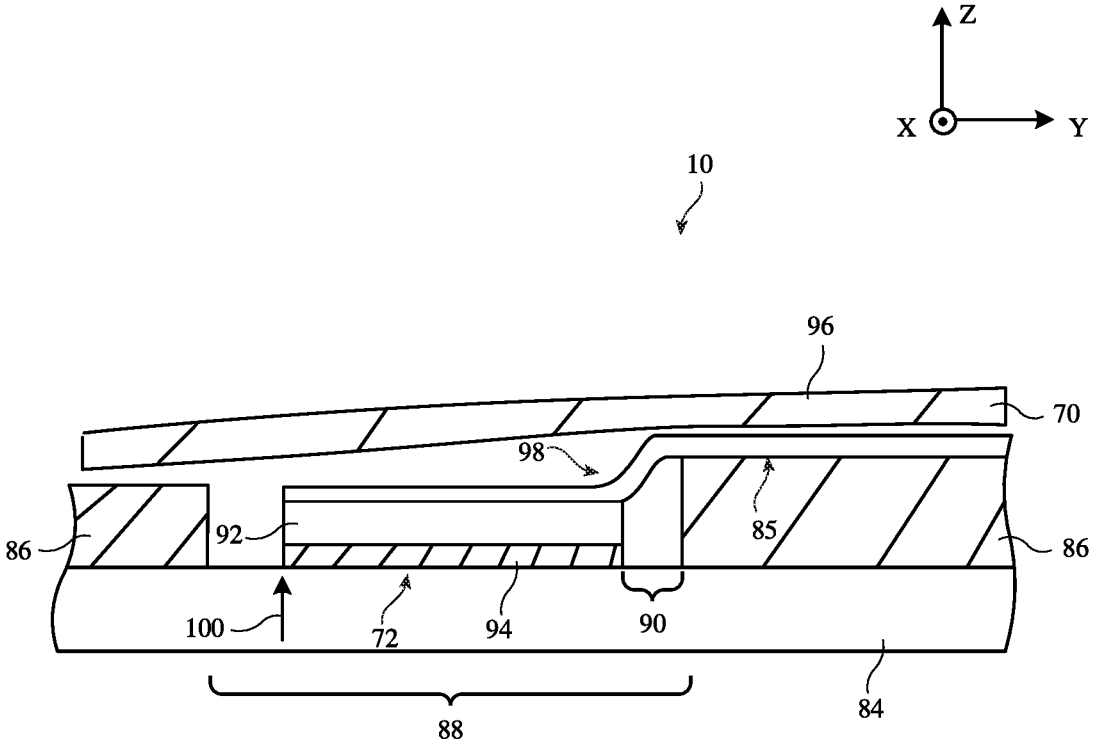
FIG. 8 is a cross-sectional side view showing how a portion of an illustrative flexible printed circuit structure having an antenna may be mounted within an opening in a conductive support plate in accordance with some embodiments.

FIG. 8 is a cross-sectional side view showing how flexible printed circuit structure 70 may be mounted within device 10. As shown in FIG. 8, device 10 may include a dielectric cover layer such as dielectric cover layer 84 and a conductive support plate such as conductive support plate 86 layered over (on) dielectric cover layer 84. Dielectric cover layer 84 and conductive support plate 86 may, for example, form a housing wall for device 10 (e.g., rear housing wall 12R of FIG. 1). Conductive support plate 86 may be an integral portion of peripheral conductive housing walls 12W (FIG. 1) or may be welded or otherwise affixed to peripheral conductive housing walls 12W if desired. Conductive support plate 86 may have an opening such as opening 88.

Flexible printed circuit structure 70 may extend along conductive support plate 86. Stub 72 of flexible printed circuit structure 70 may extend within opening 88 in conductive support plate 86. Flexible printed circuit structure 70 may have an antenna substrate such as antenna substrate 92 at stub 72. Antenna structures 94 may be formed on antenna substrate 92. Antenna structures 94 may include portions of a given antenna 40 (e.g., antennas 40-1 or 40-2 of FIG. 6) for conveying ultrawideband signals or other radio-frequency signals through dielectric cover layer 84. Stub 72 (e.g., antenna structures 94) may be pressed within opening 88, forming a bend such as bend 98 in flexible printed circuit structure 70. Stub 72 and antenna structures 94 may thereby be located between upper surface 85 of conductive support plate 86 and dielectric cover layer 84. Antenna structures 94 may be pressed against (e.g., in direct contact with) dielectric cover layer 84 (e.g., bend 98 may allow antenna structures 94 to be pressed against dielectric cover layer 84 despite the remainder of flexible printed circuit structure 70 being formed outside of opening 88). If desired, adhesive may be used to help adhere antenna structures 94 to dielectric cover layer 84.

An electromagnetic shield such as conductive shielding layer 96 may be layered over conductive support plate 86 and flexible printed circuit structure 70. Conductive shielding layer 96 may completely cover opening 88. Conductive shielding layer 96 may be galvanically connected to conductive support plate 86 (e.g., using solder, welds, or other conductive adhesives), may be placed into contact with conductive support plate 86, or may be separated from and capacitively coupled to conductive support plate 86. Conductive shielding layer 96 may include sheet metal, conductive adhesive (e.g., copper tape having an adhesive layer), conductive traces on a dielectric substrate, conductive portions of the housing for device 10, conductive foil, ferrite, or any other desired structures that block radio-frequency signals. In the absence of conductive shielding layer 96, gap 90 may radiate in response to radio-frequency signals from polarizations other than the polarization handled by antenna structures 94. This may introduce undesirable cross-polarization interference on the radio-frequency signals handled by antenna structures 94. The presence of conductive shielding layer 96 may serve to block these radio-frequency signals from causing gap 90 to radiate, thereby mitigating cross-polarization interference for antenna structures 94. The example of FIG. 8 is merely illustrative. If desired, conductive components may overlap gap 90 to prevent cross-polarization interference. Conductive shielding layer 96 may be omitted if desired. Gap 90 may have a width of zero mm if desired (e.g., stub 72 may completely fill the lateral area of opening 88).

Pressing antenna structures 94 against dielectric cover layer 84 may help to provide a uniform impedance transition across the entire lateral area of antenna structures 94 from antenna structures 94 to free space at the exterior of device 10 (e.g., without any air gaps or bubbles between antenna structures 94 and dielectric cover layer 84 that would otherwise introduce undesirable impedance discontinuities to the system). However, in practice, the material used to form flexible printed circuit structure 70 may have a tendency to lie in a substantially planar shape. The presence of bend 98 may cause flexible printed circuit structure 70 to exhibit biasing forces 100 in the +Z direction. Biasing forces 100 may be particularly pronounced at the lateral corners of stub 72 and antenna structures 94. Biasing forces 100 affect the impedance of the antenna structures in a direction parallel to the Z-axis (e.g., by introducing slight discontinuities in impedance between antenna structures 94 and dielectric cover layer 84 at the locations where the biasing forces are the strongest). Impedance discontinuities created by biasing forces 100 may be exacerbated by external forces applied to device 10 such as forces associated with drop events in which the device is dropped onto the floor or other surfaces. If care is not taken, these impedance discontinuities can undesirably limit the overall antenna efficiency for antenna structures 94 in one or more frequency bands. It may also be desirable to be able to reduce the lateral area of antenna structures 94 while still exhibiting satisfactory antenna efficiency across multiple frequency bands.

Any desired antenna structures may be used for implementing antennas 40 in regions 74, 80, and 78 of FIG. 7 (e.g., for implementing at least antennas 40-1 and 40-2 of FIG. 6 for conveying UWB signals). In one suitable arrangement that is sometimes described herein as an example, planar inverted-F antenna structures may be used for implementing antennas 40. Antennas that are implemented using planar inverted-F antenna structures may sometimes be referred to herein as planar inverted-F antennas.

Figure 9:
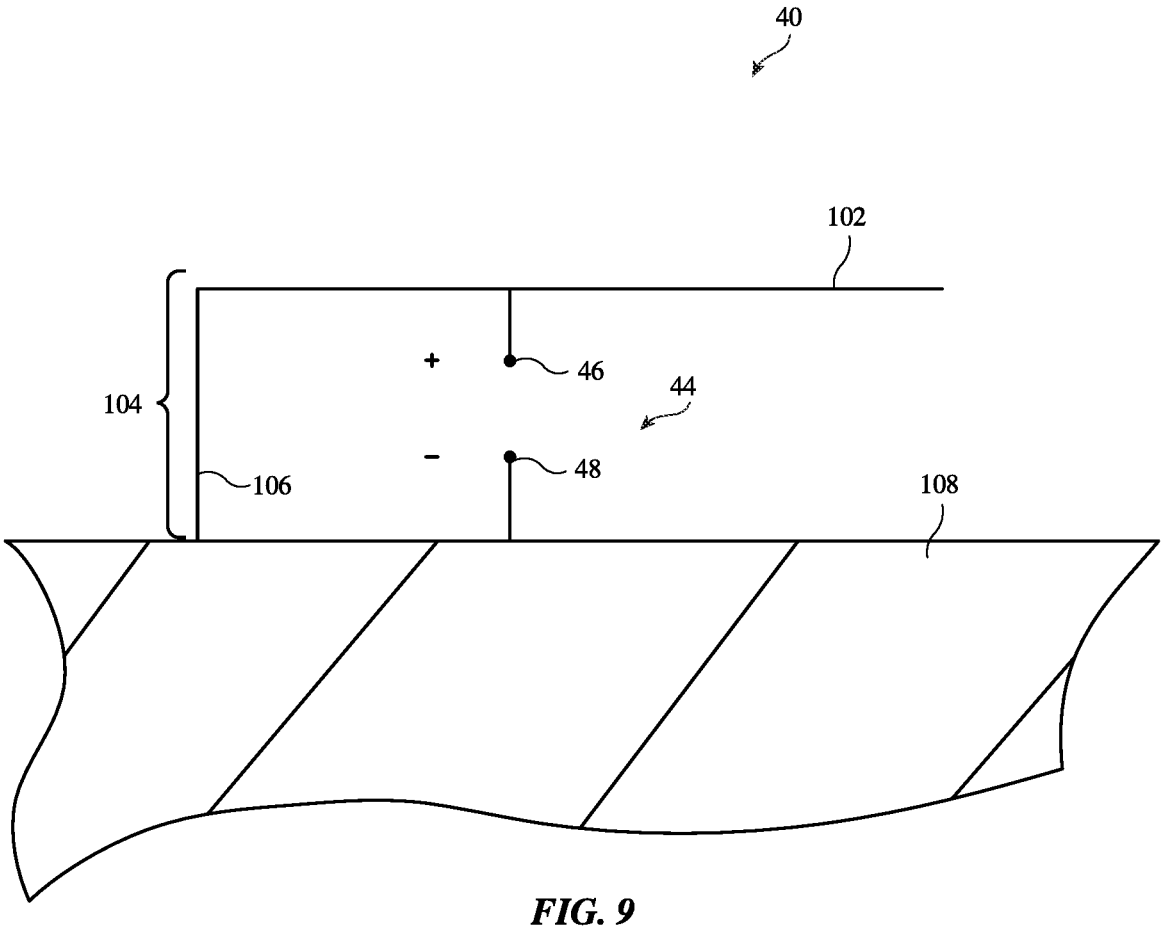
FIG. 9 is a schematic diagram of illustrative inverted-F antenna structures in accordance with some embodiments.

FIG. 9 is a schematic diagram of inverted-F antenna structures that may be used to form antenna 40 (e.g., a given one of antennas 40-1 and 40-2 of FIG. 6). As shown in FIG. 9, antenna 40 may include an antenna resonating element such as antenna resonating element 104 and an antenna ground such as antenna ground 108. Antenna resonating element 104 may include a resonating element arm 102 (sometimes referred to herein as an antenna resonating element arm) that is shorted to antenna ground 108 by return path 106. Antenna 40 may be fed by coupling a transmission line (e.g., a transmission line in radio-frequency transmission line path 50 of FIG. 3) to positive antenna feed terminal 46 and ground antenna feed terminal 48 of antenna feed 44.

Positive antenna feed terminal 46 may be coupled to resonating element arm 102 and ground antenna feed terminal 48 may be coupled to antenna ground 108. Return path 106 may be coupled between resonating element arm 102 and antenna ground 108 in parallel with antenna feed 44. The length of resonating element arm 102 may determine the response (resonant) frequency of the antenna.

Figure 10:
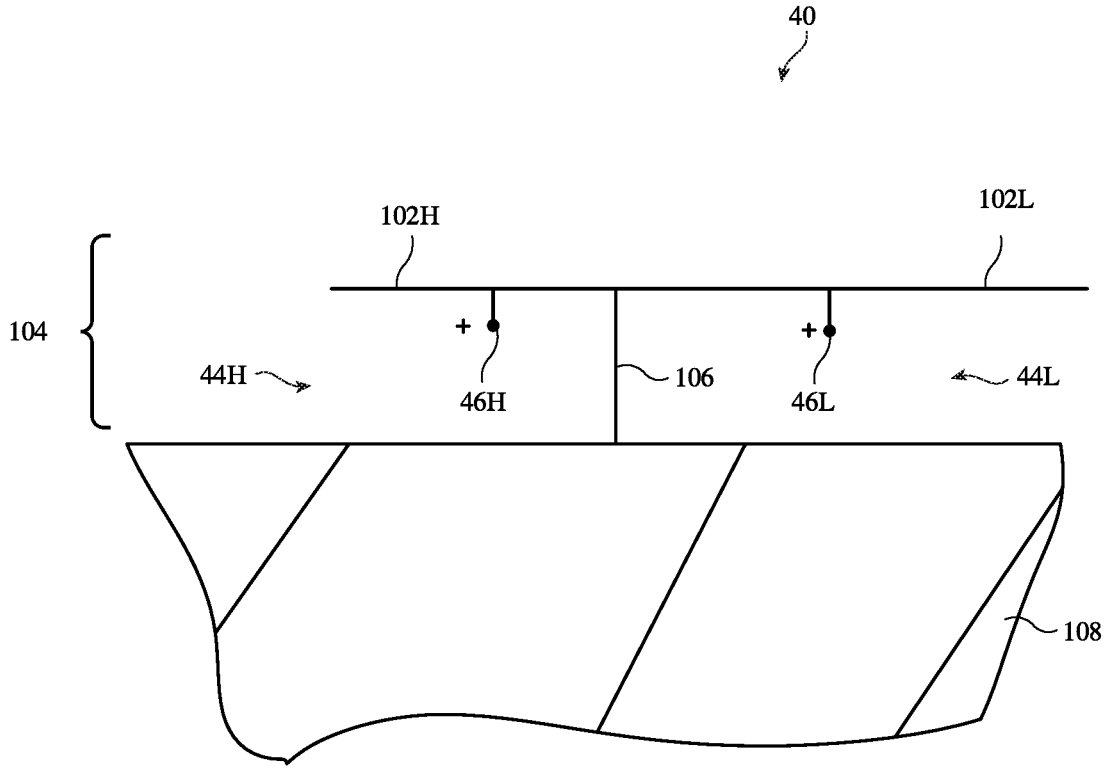
FIG. 10 is a schematic diagram of illustrative dual-band inverted-F antenna structures in accordance with some embodiments.

In the example of FIG. 9, antenna 40 is configured to cover only a single frequency band. If desired, antenna resonating element 104 may include multiple resonating element arms 102 that configure antenna 40 to cover multiple frequency bands. FIG. 10 is a schematic diagram of dual-band inverted-F antenna structures that may be used to form antenna 40 (e.g., a given one of antennas 40-1 and 40-2 of FIG. 6). As shown in FIG. 10, antenna resonating element 104 includes a first resonating element arm 102L and a second resonating element arm 102H extending from opposing sides of return path 106.

The length of first resonating element arm 102L (sometimes referred to herein as low band arm 102L) may be selected to radiate in a first frequency band and the length of second resonating element arm 102H (sometimes referred to herein as high band arm 102H) may be selected to radiate in a second frequency band at higher frequencies than the first frequency band. As an example, low band arm 102L may have a length that configures low band arm 102L to radiate in the 6.5 GHz UWB communications band whereas high band arm 102H has a length that configures high band arm 102H to radiate in the 8.0 GHz UWB communications band. The term "radiate" as used herein refers to the excitation of an antenna resonating element by radio-frequency signals that are transmitted by the antenna resonating element and/or that are received by the antenna resonating element (e.g., within the frequency band(s) of operation of the antenna resonating element).

Antenna 40 of FIG. 10 may be fed using two antenna feeds such as antenna feed 44H and antenna feed 44L. Antenna feed 44H may include a positive antenna feed terminal 46H coupled to high band arm 102H. Antenna feed 44L may include a positive antenna feed terminal 46L coupled to low band arm 102L. The ground antenna feed terminals of antenna feeds 44L and 44H are not shown in the example of FIG. 10 for the sake of clarity. If desired, antenna feeds 44L and 44H may share the same ground antenna feed terminal. Positive antenna feed terminals 46H and 46L may both be coupled to the same transmission line (e.g., to the same signal conductor 52 as shown in FIG. 3). This may, for example, optimize antenna efficiency of antenna 40 in both the frequency band covered by low band arm 102L and the frequency band covered by high band arm 102H (e.g., because antenna current may be conveyed to each resonating element arm over the corresponding positive antenna feed terminal without first shorting to ground over return path 106).

In one suitable arrangement that is sometimes described herein as an example, antenna 40 may be a dual-band planar inverted-F antenna. When configured as a dual-band planar inverted-F antenna, resonating element arms 102H and 102L may be formed using a conductive structure (e.g., a conductive trace or patch, sheet metal, conductive foil, etc.) that extends across a planar lateral area above antenna ground 108.

Figure 11:
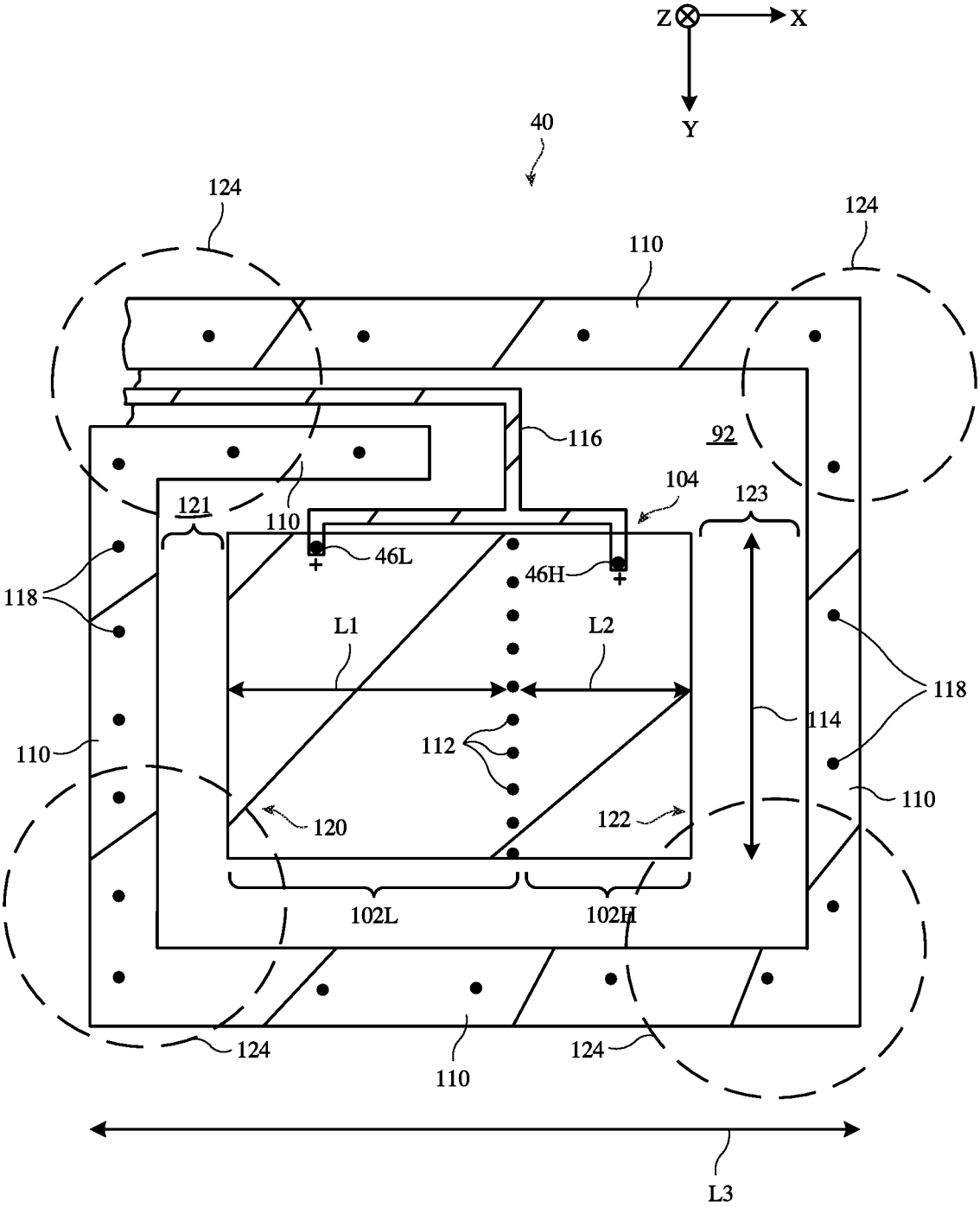
FIG. 11 is a bottom view of an illustrative dual-band planar inverted-F antenna having low band and high band arms that share a return path and that are separated by a fence of conductive vias in accordance with some embodiments.

FIG. 11 is a bottom-up view of dual-band planar inverted-F antenna structures that may be used to form antenna 40 (e.g., a given one of antennas 40-1 and 40-2 of FIG. 6). As shown in FIG. 11, antenna resonating element 104 of antenna 40 (e.g., a dual-band planar inverted-F antenna) may be formed from conductive structures such as conductive traces on a surface of the antenna substrate 92 (e.g., on an upper-most surface of antenna substrate 92). Antenna substrate 92 may be formed from any desired dielectric materials such as epoxy, plastic, ceramic, glass, foam, polyimide, liquid crystal polymer, or other materials. In one suitable arrangement that is described herein as an example, antenna substrate 92 is a flexible printed circuit substrate having stacked layers of flexible printed circuit material (e.g., polyimide, liquid crystal polymer, etc.). Antenna substrate 92 may sometimes be referred to herein as dielectric substrate 92.

As shown in FIG. 11, antenna resonating element 104 may have a planar shape with a length equal to the sum of the length L2 of high band arm 102H and the length L1 of low band arm 102L. Antenna resonating element 104 (e.g., each of resonating element arms 102H and 102L) may have a perpendicular width 114 such that antenna resonating element 104 has a planar shape that laterally extends in a given plane (e.g., the X-Y plane of FIG. 11) parallel to the antenna ground (e.g., antenna ground 108 of FIG. 10). In other words, low band arm 102L has length L1 and width 114 whereas high band arm 102H has length L2 and width 114. The example of FIG. 11 is merely illustrative and, if desired, low band arm 102L and/or high band arm 102H may have other shapes (e.g., shapes with cut-out regions to accommodate other components in the vicinity of antenna 40, shapes having any desired number of curved and/or straight edges, etc.). In these scenarios, length L1 may be the greatest lateral dimension of low band arm 102L and length L2 may be the greatest lateral dimension of high band arm 102H, as an example.

Length L2 may be selected to configure high band arm 102H to radiate in a relatively high frequency band such as the 8.0 GHz UWB communications band. Length L1 may be selected to configure low band arm 102L to radiate in a relatively low frequency band such as the 6.5 GHz UWB communications band. For example, length L2 may be approximately equal to (e.g., within 15% of) one-quarter of the effective wavelength corresponding to a frequency in the 8.0 GHz UWB communications band. Similarly, length L1 may be approximately equal to one-quarter of the effective wavelength corresponding to a frequency in the 6.5 GHz UWB communications band. These effective wavelengths are modified from free-space wavelengths by a constant value associated with the dielectric material used to form antenna substrate 92 (e.g., the effective wavelengths are found by multiplying the freespace wavelengths by a constant value that is based on the dielectric constant $d_k$ of antenna substrate 92). This example is merely illustrative and, in general, any desired frequency bands (e.g., UWB communications bands) may be covered by high band arm 102H and low band arm 102L.

Low band arm 102L may be separated from high band arm 102H in antenna resonating element 104 by a fence of conductive vias 112. Conductive vias 112 extend from the upper-most surface of antenna substrate 92, through antenna substrate 92, and to an underlying ground plane (e.g., in the direction of the Z-axis of FIG. 11). The fence of conductive vias 112 may form the return path for antenna 40 (e.g., return path 106 of FIG. 10).

Each conductive via 112 may be separated from one or more adjacent conductive vias 112 by a sufficiently narrow distance such that the portion of antenna resonating element 104 to the left of the fence of conductive vias 112 appears as an open circuit (infinite impedance) to antenna currents in the 8.0 GHz UWB communications band and such that the portion of antenna resonating element 104 to the right of the fence of conductive vias 112 appears as an open circuit (infinite impedance) to antenna currents in the 6.5 GHz UWB communications band. As an example, each conductive via 112 in the fence may be separated from one or more adjacent conductive vias 112 by one-sixth of the wavelength covered by high band arm 102H, one-eighth of the wavelength covered by high band arm 102H, one-tenth of the wavelength covered by high band arm 102H, one-fifteenth of the wavelength covered by high band arm 102H, less than one-fifteenth of the wavelength covered by high band arm 102H, less than one-sixth of the wavelength covered by high band arm 102H, etc.

If desired, an electromagnetic shielding (guard) ring such as grounded shielding ring 110 may laterally surround antenna resonating element 104 at the upper-most surface of antenna substrate 92. Grounded shielding ring 110 may be formed from conductive traces on the surface of antenna substrate 92. The conductive traces of grounded shielding ring 110 may be shorted to the antenna ground (e.g., underlying planar ground traces) by fences of conductive vias 118 extending through antenna substrate 92. Each conductive via 118 coupled to grounded shielding ring 110 may be separated from one or more adjacent conductive vias 118 by a sufficiently narrow distance such that the fences of conductive vias appear as a solid wall to radio-frequency signals at the frequency bands handled by antenna resonating element 104. Grounded shielding ring 110 may serve to isolate and shield antenna 40 from electromagnetic interference.

Grounded shielding ring 110, conductive vias 118, and the underlying planar ground traces may collectively form antenna ground 108 of FIG. 10 and may form (define) a conductive antenna cavity for antenna 40 that serves to optimize radio-frequency performance (e.g., antenna efficiency and bandwidth) for antenna 40. The antenna ground may include ground traces on one or more layers of antenna substrate 92 beneath the upper-most layer of antenna substrate 92. The ground traces may include planar ground traces extending underneath (e.g., overlapping) substantially all of antenna 40. If desired, the ground traces may also include a ring of ground traces or ground traces in other shapes overlapping grounded shielding ring 110 but formed on a layer of antenna substrate 92 between the planar ground trace and the upper-most layer of antenna substrate 92. Each layer of ground traces in antenna 40 may be coupled together using conductive vias if desired (e.g., so that all of the ground traces are held at the same ground potential).

Antenna 40 of FIG. 11 may be fed using a radio-frequency transmission line path (e.g., radio-frequency transmission line path 50 of FIG. 3). The radio-frequency transmission line path may include a transmission line such as stripline or microstrip transmission line. The transmission line may have signal traces 116 (e.g., forming a part of signal conductor 52 of FIG. 3) coupled to antenna resonating element 104. For example, signal traces 116 may have first and second branches respectively coupled to positive antenna feed terminals 46L and 46H on antenna resonating element 104.

In the example of FIG. 11, antenna 40 is only capable of conveying radio-frequency signals with a single linear polarization. In other words, high band arm 102H conveys radio-frequency signals in the 8.0 GHz UWB communications band with a given linear polarization and low band arm 102L conveys radio-frequency signals in the 6.5 UWB communications band with the same linear polarization. Additional polarizations may be covered in device 10 by providing additional antennas oriented perpendicular to each other if desired. The example of FIG. 11 is merely illustrative. If desired, antenna resonating antenna 40 and/or grounded shielding ring 110 may have other shapes (e.g., shapes having any desired number of straight and/or curved edges).

In the example of FIG. 11, antenna resonating element 104 is separated from grounded shielding ring 110 by both a first gap 121 and a second gap 123. High band arm 102H has a radiating edge 122 opposite conductive vias 112. Low band arm has a radiating edge 120 opposite conductive vias 112. The electric fields produced by antenna currents on antenna resonating element 104 may exhibit peak magnitudes at radiating edges 120 and 122 (e.g., within gaps 121 and 123). In general, antenna 40 is particularly susceptible to detuning and decreases in antenna efficiency due to impedance discontinuities at locations where the electric field magnitude is higher than at locations where the electric field magnitude is lower. Antenna 40 may therefore be particularly susceptible to impedance discontinuities at radiating edges 120 and 122 and at gaps 121 and 123. However, biasing forces in the +Z direction such as biasing forces 100 of FIG. 8 may create undesirable impedance discontinuities (e.g., in the +Z and −Z directions), particularly at the corners of antenna substrate 92 such as within regions 124 of FIG. 11. As shown in FIG. 11, regions 124 may at least partially overlap radiating edges 120 and 122 and gaps 121 and 123, where antenna 40 is most sensitive to impedance discontinuities. These forces may therefore undesirably limit the antenna efficiency of antenna 40 in one or more frequency bands. At the same time, the presence of gaps 121 and 123 and conductive vias 112 may configure antenna 40 to exhibit a relatively large footprint L3. This may cause antenna 40 to occupy an excessive amount of space within device 10. It may therefore be desirable to be able to provide antenna 40 with structures that are relatively immune to impedance discontinuities created by biasing forces 100 (FIG. 8) and that exhibit as compact a footprint as possible.

Figure 12:
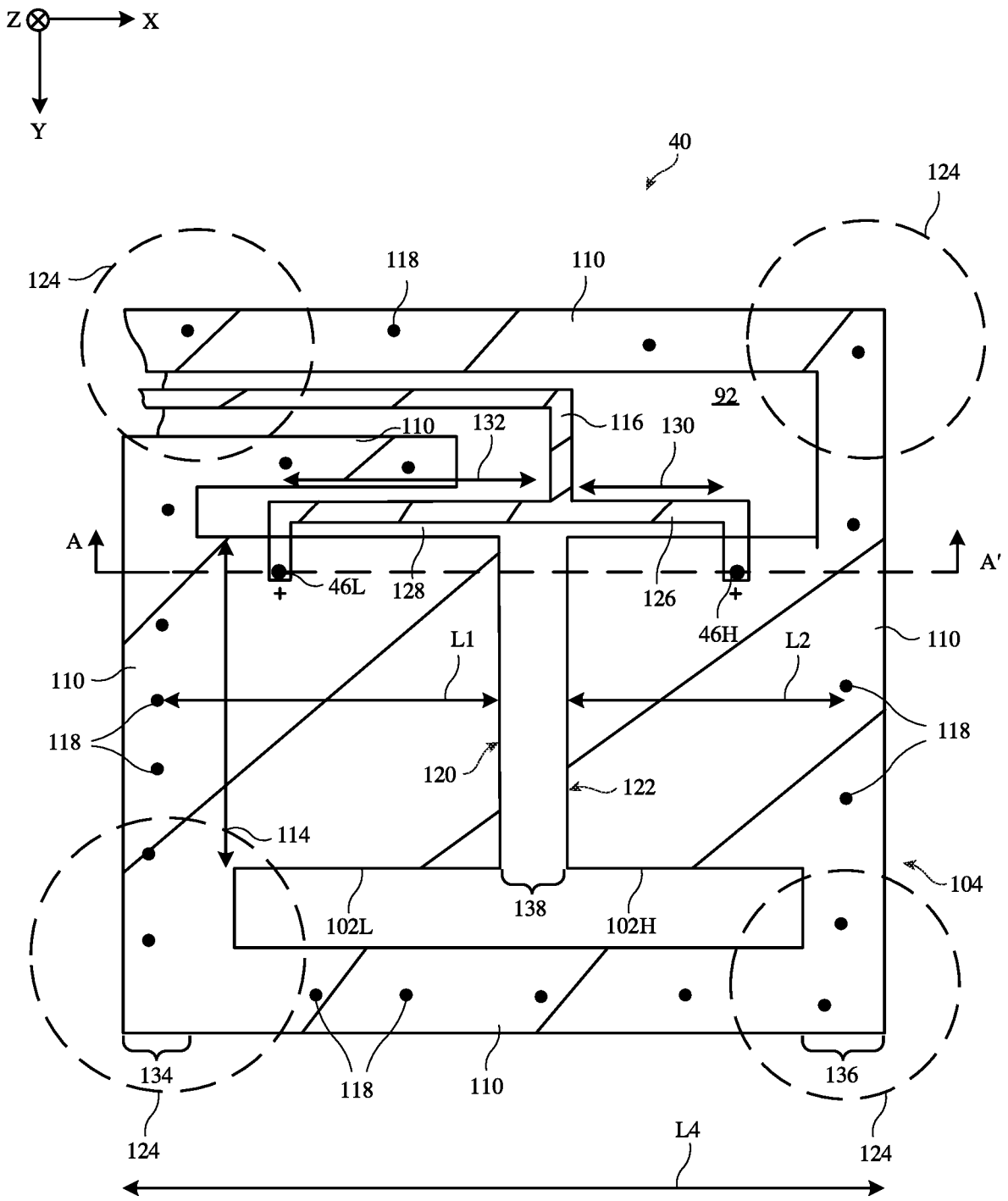
FIG. 12 is a bottom view of an illustrative dual-band planar inverted-F antenna having low band and high band arms that extend from a grounded shielding ring and that have separate return paths formed by respective fences of conductive vias in accordance with some embodiments.

FIG. 12 shows an arrangement for antenna 40 that is relatively immune to impedance discontinuities created by biasing forces 100 (FIG. 8) and that exhibits a relatively compact footprint. As shown in FIG. 12, low band arm 102L and high band arm 102H may have edges that are defined by respective portions of grounded shielding ring 110 (e.g., low band arm 102L, high band arm 102H, and grounded shielding ring 110 may be formed from continuous conductive traces on antenna substrate 92 and may be deposited on antenna substrate 92 at the same time using the same printing/deposition process). In other words, low band arm 102L and high band arm 102H may be integral with grounded shielding ring 110. Low band arm 102L, high band arm 102H, and grounded shielding ring 110 may form antenna structures 94 of FIG. 8, for example.

Low band arm 102L may extend from a first (left) segment (side) 134 of grounded shielding ring 110 and towards high band arm 102H (e.g., parallel to the X-axis). High band arm 102H may extend from a second (right) segment (side) 136 of grounded shielding ring 110 and towards low band arm 102L (e.g., parallel to the X-axis). Segment 134 of grounded shielding ring 110 may be the segment of grounded shielding ring 110 opposite to segment 136 of grounded shielding ring 110. Grounded shielding ring 110 may have a third segment that extends perpendicular to segments 134 and 136 and that couples segment 134 to segment 136. In this arrangement, antenna 40 may include separate return paths for low band arm 102L and high band arm 102H (e.g., return paths such as return path 106 of FIGS. 9 and 10). The return paths for low band arm 102L and high band arm 102H may be formed from respective sets (fences) of the conductive vias 118 coupled to grounded shielding ring 110. For example, the return path for low band arm 102L may be formed from a first set (fence) of conductive vias 118 coupled to first segment 134 of grounded shielding ring 110 (e.g., where the first set of conductive vias shorts low band arm 102L to the ground traces in the 6.5 GHz UWB communications band), whereas the return path for high band arm 102H is formed from a second set (fence) of conductive vias 118 coupled to second segment 136 of grounded shielding ring 110 (e.g., where the second set of conductive vias shorts high band arm 102H to the ground traces in the 8.0 GHz UWB communications band).

The edge of low band arm 102L opposite the first set of conductive vias (segment 134 of grounded shielding ring 110) may form radiating edge 120 of low band arm 102L (e.g., low band arm 102L may have a first end defined by or formed from segment 134 of grounded shielding ring 110 and may have an opposing second end that forms radiating edge 120). The edge of high band arm 102H opposite the second set of conductive vias (segment 136 of grounded shielding ring 110) may form radiating edge 122 of high band arm 102H (e.g., high band arm 102H may have a third end defined by or formed from segment 136 of grounded shielding ring 110 and may have an opposing fourth end that forms radiating edge 122). When arranged in this way, radiating edge 120 of low band arm 102L faces radiating edge 122 of high band arm 102H.

Radiating edge 120 is separated from radiating edge 122 by gap 138. Gap 138, low band arm 102L, and high band arm 102H may have width 114 parallel to the Y-axis. The length of low band arm 102L from radiating edge 120 to the first set of conductive vias 118 may define the length L1 of low band arm 102L. The length of high band arm 102H from radiating edge 122 to the second set of conductive vias 118 may define the length L2 of high band arm 102H. Length L1 may be selected to configure low band arm 102L to radiate in a relatively low frequency band such as the 6.5 GHz UWB communications band. Length L1 may, for example, be approximately equal to one-quarter of the effective wavelength corresponding to a frequency in the 6.5 GHz UWB communications band. Similarly, length L2 may, for example, be approximately equal to (e.g., within 15% of) one-quarter of the effective wavelength corresponding to a frequency in the 8.0 GHz UWB communications band.

As shown in FIG. 12, signal traces 116 may include a first branch 128 coupled to positive antenna feed terminal 46L on low band arm 102L (e.g., using a conductive feed via extending through antenna substrate 92). Signal traces 116 may also include a second branch 126 coupled to positive antenna feed terminal 46H on high band arm 102H (e.g., using a conductive feed via extending through antenna substrate 92). The length 132 of first branch 128 and/or the width of first branch 128 (as measured perpendicular to length 132) may be selected to help match the impedance of signal traces 116 to the impedance of low band arm 102L (e.g., within the frequency band handled by low band arm 109L). The length 130 of second branch 126 and/or the width of second branch 126 (as measured perpendicular to length 130) may be selected to help match the impedance of signal traces 116 to the impedance of high band arm 102H (e.g., within the frequency band handled by high band arm 102H). First branch 128 and/or second branch 126 may additionally or alternatively include one or more transmission line stubs and/or meandering segments to help match the impedance of signal traces 116 to the impedance of antenna resonating element 104 in one or more frequency bands. First branch 128 may be configured to form an open circuit (infinite) impedance in the frequency band handled by high band arm 102H and second branch 126 may be configured to form an open circuit impedance in the frequency band handled by low band arm 102L, if desired.

In the arrangement of FIG. 12, the radiating edges of antenna resonating element 104 (e.g., radiating edges 120 and 122) are located at or near the center of antenna substrate 92. Antenna currents on low band arm 102L may produce peak electric field magnitudes at radiating edge 120 and within gap 138. Similarly, antenna currents on high band arm 102H may produce peak electric field magnitudes at radiating edge 122 and within gap 138. Because radiating edges 120 and 122 and gap 138 are located relatively far from the corners of antenna substrate 92 (e.g., radiating edges 120 and 122 and gap 138 do not overlap regions 124), any relatively strong biasing forces such as biasing forces 100 of FIG. 8 will have little or no impact on the performance of antenna 40 (e.g., because the impedance discontinuities created by the biasing forces are concentrated within regions 124, which are relatively far away from radiating edges 120 and 122 and gap 138). Antenna 40 of FIG. 12 will therefore be able to operate with satisfactory antenna efficiency in both the 8.0 GHz and 6.5 GHz UWB frequency bands regardless of any impedance discontinuities created by biasing forces 100 of FIG. 8. At the same time, because antenna 40 only has a single gap 138 (as opposed to a pair of gaps such as gaps 121 and 123 of FIG. 11) and because antenna 40 need not include an additional fence of conductive vias to separate low band arm 102L and high band arm 102H (e.g., conductive vias 112 of FIG. 11), antenna 40 may exhibit a relatively compact lateral footprint L4 that is less than lateral footprint L3 of FIG. 11. The example of FIG. 12 is merely illustrative. Low band arm 102L, high band arm 102H, and radiating edges 120 and 122 may have other shapes if desired.

Figure 13:
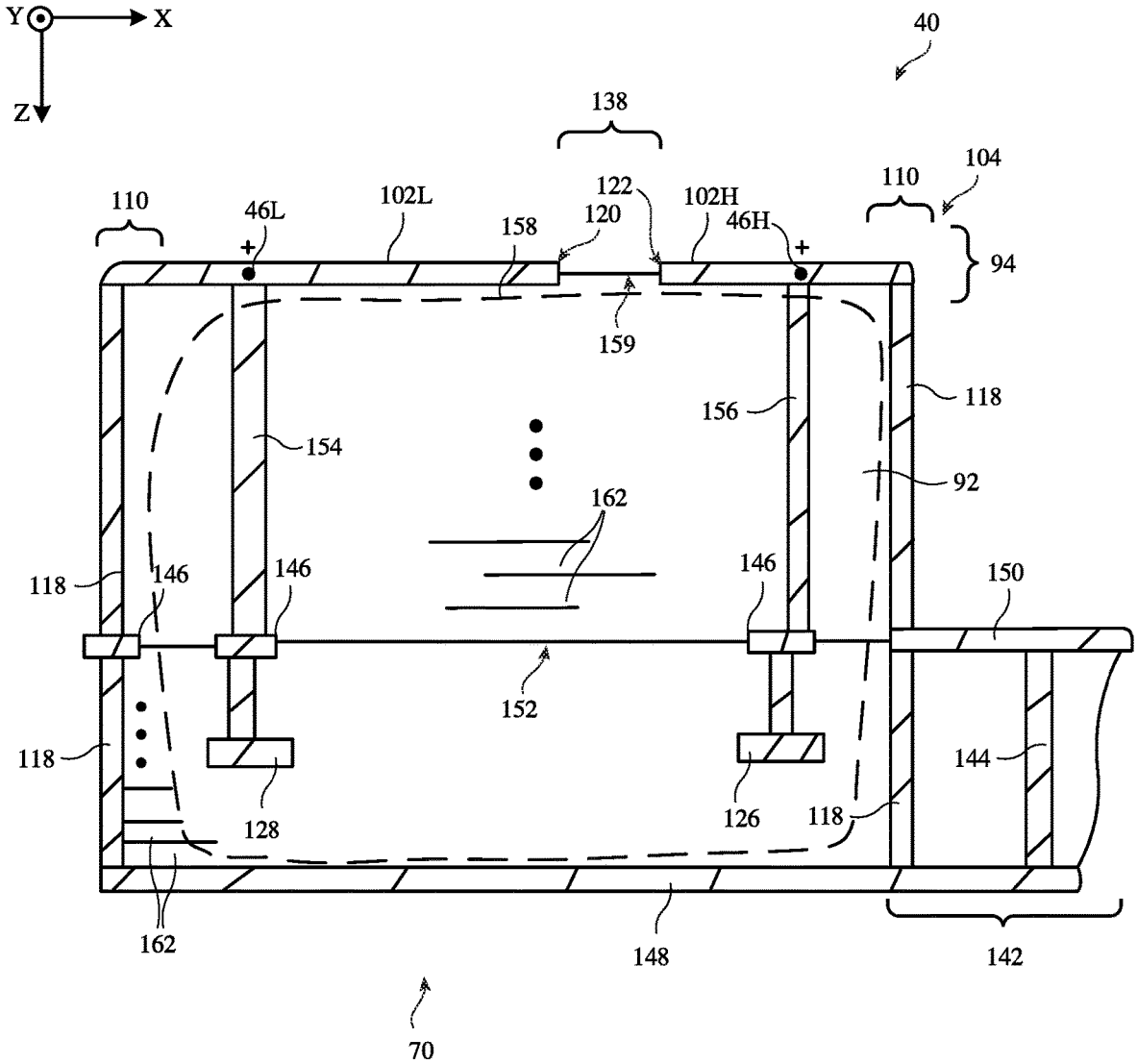
FIG. 13 is a cross-sectional side view of an illustrative antenna of the type shown in FIG. 12 in accordance with some embodiments.

FIG. 13 is a cross-sectional side view of antenna 40 of FIG. 12 (e.g., as taken along line AA' of FIG. 12). As shown in FIG. 13, low band arm 102L, high band arm 102H, and grounded shielding ring 110 may be formed from conductive traces on surface 159 of antenna substrate 92 (e.g., may form antenna structures 94). Antenna substrate 92 may include one or more stacked layers 162 of dielectric material (e.g., flexible printed circuit material such as polyimide or liquid crystal polymer, ceramic, etc.). This example is merely illustrative and, if desired, one or more additional layers 162 of antenna substrate 92 may be formed over surface 159.

Antenna substrate 92 may include a tail such as tail 142 (e.g., a flexible printed circuit tail) that extends beyond the lateral outline of antenna resonating element 104 (antenna 40, antenna substrate 40, and tail 142 may all form part of flexible printed circuit structure 70). Tail 142 may, for example, include one or more bends such as bend 98 of FIG. 8 (e.g., tail 142 may form portions of flexible printed circuit structure 70 of FIG. 7 outside of stubs 72). A radio-frequency transmission line for antenna 40 may be formed on tail 142 and may extend into antenna substrate 92. Antenna substrate 92 may include conductive traces that form a ground plane (layer) such as planar ground traces 148. Planar ground traces 148 may be formed on a surface of antenna substrate 92 or may be embedded within layers 162 of antenna substrate 92. Planar ground traces 148 may form a part of the radio-frequency transmission line for antenna 40 and may extend under antenna resonating element 104 (e.g., antenna resonating element 104 may overlap planar ground traces 148). Conductive vias 144 may extend through tail 142 of flexible printed circuit substrate 92 to short the planar ground traces 148 to additional ground traces 150.

The signal traces of the radio-frequency transmission line (e.g., signal traces 116 of FIG. 12) may include first branch 128 and second branch 126 embedded in the layers 162 of antenna substrate 92. Conductive feed via 154 may extend from first branch 128 to low band arm 102L at positive antenna feed terminal 46L. Conductive feed via 156 may extend from second branch 126 to high band arm 102H at positive antenna feed terminal 46H. Conductive feed vias 156 and 154 may be coupled to conductive contacts such as landing pads 146 at the interfaces between each layer 162 of antenna substrate 92 (only a single layer of landing pads 146 is shown in FIG. 13 for the sake of clarity).

As shown in FIG. 13, grounded shielding ring 110 may be formed on surface 159 of antenna substrate 92. Radiating edge 120 of low band arm 102L may be separated from radiating edge 122 of high band arm 102H at surface 159 by gap 138. Grounded shielding ring 110 may be shorted to planar ground traces 148 by conductive vias 118 extending through antenna substrate 92. Conductive vias 118 may be coupled to landing pads 146 at the interfaces between each layer 162 in antenna substrate 92.

Conductive vias 118, low band arm 102L, high band arm 102H, grounded shielding ring 110, and planar ground traces 148 may define a continuous antenna cavity (volume) 158 for antenna 40. In general, the bandwidth of antenna 40 is proportional to the size of antenna cavity 158. The portion of surface 152 underlying antenna resonating element 104 may be free from grounded traces to maximize the size of antenna cavity 158 (e.g., allowing antenna cavity 158 to extend downward to planar ground traces 148). This may serve to maximize bandwidth and efficiency for antenna 40. Grounded shielding ring 110 and conductive vias 118 may also serve to shield antenna 40 from external electromagnetic interference.

The foregoing is merely illustrative and various modifications can be made by those skilled in the art without departing from the scope and spirit of the described embodiments. The foregoing embodiments may be implemented individually or in any combination.

What is claimed is:

1. Apparatus comprising:

a substrate having at least first and second stacked dielectric layers;

ground traces on the first dielectric layer;

a shielding ring on the second dielectric layer, wherein the shielding ring has first and second segments;

conductive vias that couple the shielding ring to the ground traces through the substrate;

a first antenna resonating element arm on the second dielectric layer, wherein the first antenna resonating element arm extends from the first segment of the shielding ring to a first radiating edge; and a second antenna resonating element arm on the second dielectric layer, wherein the second antenna resonating element arm extends from the second segment of the shielding ring to a second radiating edge, the second radiating edge being separated from the first radiating edge by a gap.

2. The apparatus of claim 1, wherein the conductive vias comprise first and second sets of conductive vias, the first set of conductive vias couples the first segment of the shielding ring to the ground traces, the first set of conductive vias forms a first return path for the first antenna resonating element arm, the second set of conductive vias couples the second segment of the shielding ring to the ground traces, and the second set of conductive vias forms a second return path for the second antenna resonating element arm.

3. The apparatus of claim 2, wherein the first segment of the shielding ring is located at a first side of the shielding ring and the second segment of the shielding ring is located at a second side of the shielding ring opposite the first side.

4. The apparatus of claim 1, further comprising:

signal traces on the substrate, wherein the signal traces comprise first and second branches;

a first conductive feed via that couples the first branch to a first positive antenna feed terminal on the first antenna resonating element arm; and a second conductive feed via that couples the second branch to a second positive antenna feed terminal on the second antenna resonating element arm.

5. The apparatus of claim 1, wherein the first antenna resonating element arm is configured to radiate in a first frequency band and the second antenna resonating element is configured to radiate in a second frequency band that is different from the first frequency band.

6. The apparatus of claim 5, wherein the first frequency band comprises a 6.5 GHz ultra-wideband communications band and the second frequency band comprises an 8.0 GHz ultra-wideband communications band.

7. The apparatus of claim 1, wherein the substrate comprises a flexible printed circuit substrate.

8. An electronic device comprising:

a substrate;

a ground plane on a first surface of the substrate;

conductive traces on a second surface of the substrate, wherein the conductive traces comprise:

a first antenna arm configured to radiate in a first frequency band, a second antenna arm configured to radiate in a second frequency band that is different from the first frequency band, and a ring that runs around the first and second antenna arms;

a first set of conductive vias that couple the ring to the ground plane through the substrate and that short the first antenna arm to the ground plane; and a second set of conductive vias that couple the ring to the ground plane through the substrate and that short the second antenna arm to the ground plane.

9. The electronic device of claim 8, wherein the first antenna arm has a first radiating edge and the first antenna arm extends from a first segment of the ring to the first radiating edge.

10. The electronic device of claim 9, wherein the second antenna arm has a second radiating edge, the second antenna arm extends from a second segment of the ring to the second radiating edge, and the first radiating edge is separated from the second radiating edge by a gap at the second surface of the substrate.

11. The electronic device of claim 10, further comprising:

a dielectric cover layer; and a conductive support plate on the dielectric cover layer, wherein the conductive support plate has an opening, the substrate is mounted within the opening and against the dielectric cover layer, and the first and second resonating element arms are configured to radiate through the dielectric cover layer.

12. The electronic device of claim 11, further comprising:

a display, wherein the dielectric cover layer forms a housing wall for the electronic device opposite the display.

13. The electronic device of claim 11, further comprising:

a shielding layer that covers the opening and the substrate.

14. The electronic device of claim 11, further comprising:

a flexible printed circuit tail extending from the substrate, wherein the flexible printed circuit tail has at least one bend.

15. The electronic device of claim 8, further comprising:

a radio-frequency transmission line having a signal conductor on the substrate, wherein the signal conductor includes first and second branches;

a first conductive feed via that couples the first branch to a first positive antenna feed terminal on the first antenna arm; and a second conductive feed via that couples the second branch to a second positive antenna feed terminal on the second antenna arm.

16. The electronic device of claim 8, wherein the first frequency band comprises a 6.5 GHz ultra-wideband communications band and the second frequency band comprises an 8.0 GHz ultra-wideband communications band.

17. An antenna comprising:

a ring of conductive traces having first and second segments;

a first arm having opposing first and second ends, wherein the first end is formed from the first segment of the ring of conductive traces, the first arm being configured to radiate in a first frequency band;

a first antenna feed coupled to the first arm;

a second arm having opposing third and fourth ends, wherein the fourth end faces the second end of the first arm, the second arm is configured to radiate in a second frequency band that is higher than the first frequency band, and the third end is formed from the second segment of the ring of conductive traces;

a second antenna feed coupled to the second arm;

a ground plane; and a set of conductive vias that couples the first end of the first arm to the ground plane.

18. The antenna of claim 17, further comprising:

an additional set of conductive vias that couples the third end of the second arm to the ground plane.

19. The antenna of claim 18, wherein the ring of conductive traces is configured to form a grounded shielding ring for the antenna.

20. The antenna of claim 19, wherein the first frequency band comprises a 6.5 GHz ultra-wideband communications band and the second frequency band comprises an 8.0 GHz ultra-wideband communications band.

* * * * *